US012631402B2

(12) United States Patent
Ding et al.

(10) Patent No.: US 12,631,402 B2
(45) Date of Patent: May 19, 2026

(54) THERMAL ENERGY STORAGE

(71) Applicant: VITAL THERMOTECH LIMITED, Blackburn (GB)

(72) Inventors: Yulong Ding, Edgbaston (GB); Maria Elena Navarro Rivero, Edgbaston (GB); Zhu Jiang, Edgbaston (GB); Argyrios Anagnostopoulos, Edgbaston (GB)

(73) Assignee: VITAL THERMOTECH LIMITED, Blackburn (GB)

( * ) Notice: Subject to any disclaimer, the term of this patent is extended or adjusted under 35 U.S.C. 154(b) by 92 days.

(21) Appl. No.: 18/836,556

(22) PCT Filed: Feb. 7, 2023

(86) PCT No.: PCT/EP2023/053000
§ 371 (c)(1),
(2) Date: Aug. 7, 2024

(87) PCT Pub. No.: WO2023/152134
PCT Pub. Date: Aug. 17, 2023

(65) Prior Publication Data

US 2025/0137733 A1 May 1, 2025

(30) Foreign Application Priority Data

Feb. 8, 2022 (GB) ..... 2201581

(51) Int. Cl.
*F28D 20/02* (2006.01)

(52) U.S. Cl.
CPC ..... *F28D 20/02* (2013.01); *F28D 20/023* (2013.01)

(58) Field of Classification Search
CPC ..... F28D 20/02; F28D 20/023; F28D 2020/0017; F28D 20/0056; F28D 20/025;
(Continued)

(56) References Cited

U.S. PATENT DOCUMENTS 5,007,478 A * 4/1991 Sengupta ..... F28D 20/023 165/104.19
5,626,936 A * 5/1997 Alderman ..... B32B 3/08 428/323

(Continued)

FOREIGN PATENT DOCUMENTS

CN 108531139 A 9/2018
CN 113 136 169 A 7/2021
CN 114214039 A 3/2022

OTHER PUBLICATIONS

International Search Report and Written Opinion dated Apr. 17, 2023 corresponding to International Patent Application No. PCT/EP2023/053000.

(Continued)

*Primary Examiner* — Jon T. Schermerhorn, Jr.
(74) *Attorney, Agent, or Firm* — SQUIRE PATTON BOGGS (US) LLP

(57) ABSTRACT

Thermal Energy Storage A thermal energy storage module comprising a composite phase change material, wherein the composite phase change material comprises: a phase change material having a composition which absorbs or releases heat isothermally, or substantially isothermally, by transitioning, in a respective transition direction, between a first phase state and a second phase state at a predetermined transition temperature, wherein the composite phase change material comprises at least 40 wt % of the phase change material, based on the total weight of the composite phase change material, the phase change material being in the form of a continuous phase, a discrete phase, or a mixture of continuous and discrete phases distributed within the composite phase change material; a structural material for structurally shape-stabilising the phase change material, the structural material comprising particles which are solid in a predetermined working temperature range including the
(Continued)

Figure 1:
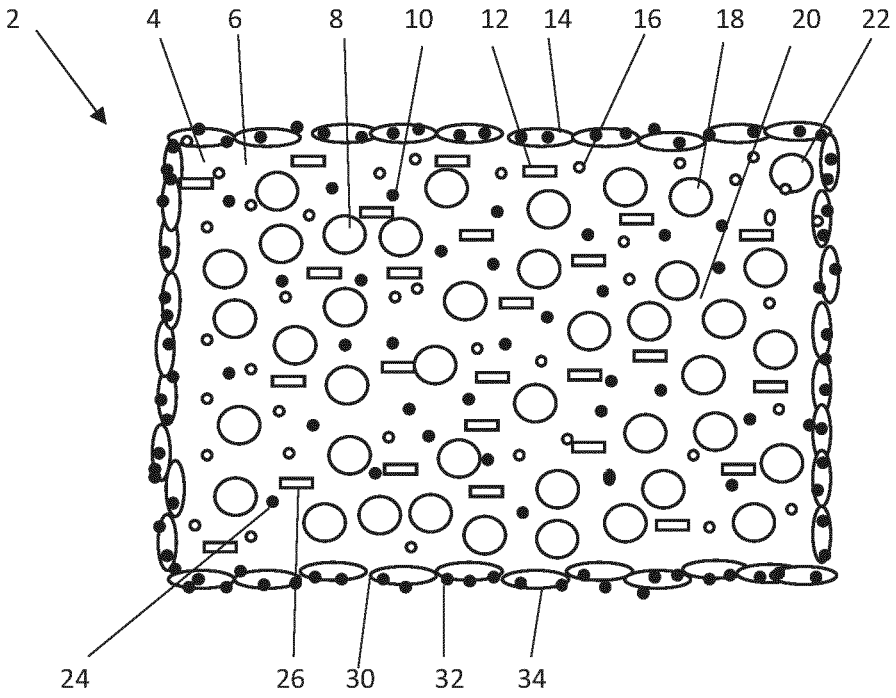

predetermined transition temperature and are chemically compatible with the phase change material, wherein, for structurally shape-stabilising the phase change material, the phase change material is contained in interparticle regions between the particles of the structural material, wherein the composite phase change material comprises at least 10 wt % of the structural material, based on the total weight of the composite phase change material; and a plurality of voids distributed within the composite phase change material, wherein the plurality of voids accommodates at least a portion of a volumetric change of both the phase change material and the structural material in the predetermined working temperature range.

26 Claims, 1 Drawing Sheet

(58) Field of Classification Search
CPC ..... F28D 20/026; C09K 5/063; C09K 5/06; Y02E 60/14
USPC ..... 165/10
See application file for complete search history.

(56) References Cited

U.S. PATENT DOCUMENTS 5,770,295 A * 6/1998 Alderman ..... E04B 9/045 428/323
7,641,812 B2 * 1/2010 Alderman ..... E04B 1/78 165/104.19
9,650,556 B2 * 5/2017 Oxley ..... C09K 5/12
10,086,675 B2 * 10/2018 Swoboda ..... B60H 1/00271
12,259,192 B2 * 3/2025 Ling ..... F28D 20/0034
12,280,518 B2 * 4/2025 Cui ..... F28D 20/023
12,495,722 B2 * 12/2025 Cheng ..... H10N 70/023
2007/0173154 A1 * 7/2007 Hartmann ..... D02G 3/404 428/313.5
2007/0202289 A1 * 8/2007 Kranz ..... H01L 23/4275 257/E23.101
2008/0230203 A1 * 9/2008 Christ ..... C09K 5/063 165/10
2012/0018116 A1 * 1/2012 Mathur ..... B65B 5/06 165/10
2012/0187332 A1 * 7/2012 Iruvanti ..... C08L 63/00 977/773
2018/0156546 A1 * 6/2018 naser ..... F28D 20/023
2019/0053634 A1 * 2/2019 Chirackal ..... D01F 6/46
2021/0102106 A1 4/2021 Zahir et al.
2022/0186947 A1 6/2022 Boetcher et al.
2024/0422943 A1 * 12/2024 Sharar ..... H01L 23/4275
2025/0115798 A1 * 4/2025 Huang ..... C08J 3/226

OTHER PUBLICATIONS

Combined Search and Examination Report under Sections 17 and 18(3) dated Jul. 29, 2022 corresponding to United Kingdom application No. GB2201581.2.
Zhu Jiang et al., "Fabrication of Form Stable Composite Phase Change Materials for Thermal Energy Storage by Direct Powder Incorporation with a Preheating Process," Power Technology, vol. 391, Jun. 24, 2021, pp. 544-556, XP086705705.
Zhu Jiang et al., "A review on the fabrication methods for structurally stabilised composite phase change materials and their impacts on the properties of materials," Renewable and Sustainable Energy Reviews, vol. 159, Feb. 16, 2022, XP086989770.

* cited by examiner

THERMAL ENERGY STORAGE

The present invention relates to a thermal energy storage module comprising a composite phase change material, a thermal energy storage unit comprising one or more of the thermal energy storage modules, and a thermal energy storage device comprising a plurality of the thermal energy storage units.

Currently, fossil fuel-based energy is used to power roughly 80% of the total global energy demand. Dependency on non-sustainable pathways to generate energy coupled with a rapidly growing global energy demand has led to considerable environmental challenges. A sustainable solution towards these issues is high penetration of renewable energy with the sun being the most abundant source of "clean energy". One of the largest barriers of solar energy is uncertainty in production coupled with intermittency in demand/supply. Furthermore, a transition to a renewable-based life leads to a higher number of energy conversion steps throughout the energy supply chain, which necessities a coordinated optimization of energy production. The majority of energy losses throughout these conversion steps are in the form of heat. One of the most promising cost-effective technologies that can provide leverage to this problem is thermal energy storage (TES).

TES is broadly categorised into sensible, latent and thermochemical. Sensible-based TES is a mature technology and has been used in large scale for hundreds of years but has a low energy density. Thermochemical based TES has a high energy density but is still at the early stage of research. Latent heat thermal energy storage (LHTES) systems have been extensively investigated in recent years and large-scale industrial deployments have been reported for peak-shaving of electricity grids, solar energy utilisation and waste heat recovery.

The core principle of LHTES systems is centred on the ability of a material, commonly referred to as the phase change material (PCM), to absorb/release heat isothermally through its transition from one state to another (most commonly between solid and liquid). However, PCMs suffer from one or more of the following disadvantages: poor thermal conductivity, volume change, corrosion and sub-cooling. These affect their performance at both the device and system levels, but can be largely resolved by encompassing them in a porous matrix. The resulting materials are called composite phase change materials (CPCMs). CPCMs have been shown to considerably improve shape stabilization, thermal conductivity, corrosion reduction and mechanical properties. Due to simplicity and less demanding requirements, cold compression is regarded to be one of the most favourable routes for large-scale CPCM fabrication.

Even after encompassing the CPCMs, their porosity is sometimes still high and the PCM loading is not all very high (<60 wt. %). This implies that the full potential of CPCMs has not yet been realised and there is a considerable room for further enhancement of thermal conductivity (due to high porosity) and energy density.

CPCMs are fabricated with the aim of maximizing thermal conductivity, mass and energy densities, compressive strength, and thermal stability while minimizing supporting material content, porosity, and thermal shock effects. These are all dependent on the CPCM microstructure, for which the formation mechanisms are not yet well understood.

Conclusively, CPCMs are a leverage to many of PCM's disadvantages, but still have large room of improvement in terms of thermal performance.

Accordingly, it is an aim of the present invention to provide a composite phase change material, in a thermal energy storage module, which exhibits highly desirable properties for thermal energy storage, with good thermal capacity and thermal conductivity, good physical and chemical stability and compatibility, and good mechanical properties, which can also be manufactured in a cost-effective manner.

Accordingly, the present invention provides a thermal energy storage module according to claim 1.

Optional or preferred features are defined in dependent claims 2 to 23.

The present invention also provides a thermal energy storage unit according to claim 24.

Optional or preferred features are defined in dependent claim 25.

The present invention also provides a thermal energy storage device according to claim 26.

Figure 2:
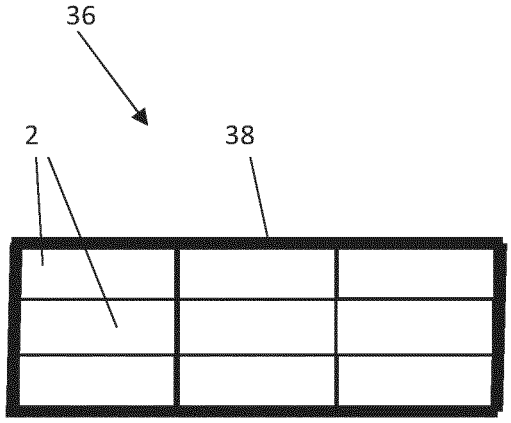

Embodiments of the present invention will now be described by way of example only with reference to the accompanying drawings, in which:

FIG. 1 is a schematic cross-section through a thermal energy storage module in accordance with an embodiment of the present invention; and FIG. 2 is a schematic cross-section through a thermal energy storage unit in accordance with another embodiment of the present invention, the unit including an assembly of a plurality of the modules illustrated in FIG. 1.

Referring to FIG. 1, there is shown a thermal energy storage module 2 in accordance with a preferred embodiment of the present invention. In FIG. 1, for the purpose of clarity of illustration various features of the thermal energy storage module 2 are illustrated schematically using an exaggerated scale so that they may be more clearly shown in the Figure. The preferred dimensions of the various features are described hereinbelow. Also, for clarity of illustration particles are shown as being spherical, oval or rectangular, whereas in various embodiments of the present invention the particles of the various components described herein below may have any desired shape and morphology, and are not geometrically shaped as illustrated.

Although a variety of methods are known to those skilled in the art for measuring particle size and void size, in this specification when any reference to particle size, or void size, is made, it is to be understood that the respective measured parameter is to be measured using dynamic laser light scattering and laser diffraction based methods, in particular using a Malvern® Nanosizer apparatus (dynamic light scattering), and Malvern® Mastersizer (laser diffraction). These measurements are often validated by using optical and electron microscopes. Furthermore, any average particle of void size is calculated by calculating the arithmetical mean size by number, for a statistically relevant number of particles or voids, for example 100 particles or voids.

The thermal energy storage module 2 comprises a composite phase change material 4. In the preferred embodiment, the composite phase change material 4 comprises a plurality of components, in particular a phase change material 6, a structural material 8 (schematically indicated by large unfilled circles in FIG. 1), an anti-leakage additive 10 (schematically indicated by small filled circles in FIG. 1), a heat transfer enhancement material 12 (schematically indicated by unfilled rectangles in FIG. 1), a plurality of voids 16 (schematically indicated by small unfilled circles in FIG. 1) distributed within the composite phase change material 4 and an exterior layer 14.

The phase change material 6 has a composition which absorbs or releases heat isothermally, or substantially isothermally, by transitioning, in a respective transition direction, between a first phase state and a second phase state at a predetermined transition temperature. In use, the phase change material 6 functions to store thermal energy, both latent heat as a result of the phase state transition, and sensible heat, whereas all other components of the composite phase change material store sensible heat.

The phase change material 6 comprises one or more phase change materials (PCMs) selected from inorganic or organic phase change materials, or any mixture thereof, which are known to those skilled in the art of thermal energy storage. The selection of the PCM(s) to form the phase change material 6 typically depends upon the particular thermal energy storage application for which the thermal energy storage module 2 is designed or intended to be used. For example, the phase change material 6 may be selected to exhibit predetermined transition temperature within a desired predetermined working temperature range for the thermal energy storage module 2.

In one non-limiting embodiment of the present invention, the phase change material 6 comprises at least one inorganic salt or a mixture of a plurality of inorganic salts. The inorganic salts, typically alkali metal salts, may be selected from the group consisting of nitrates (e.g. $NaNO_3$, $KNO_3$ and $LiNO_3$), nitrites (e.g. $NaNO_2$ and $KNO_2$), carbonates (e.g. $Na_2CO_3$, $Li_2CO_3$, $K_2CO_3$), chlorides (e.g. KCl, NaCl), bromides (e.g. KBr, LiBr, NaBr, $Li_2Br$), fluorides (e.g. LiF, KF, NaF), sulphates (e.g. $Na_2SO_4$ and $K_2SO_4$), and hydroxides (e.g. NaOH, KOH, LiOH).

Typically, when a mixture of PCMs is provided, for example when the PCMs are inorganic salts, the phase change material comprises a binary, ternary or quaternary eutectic mixture of individual phase change material components.

In one particular example, phase change material 6 comprises a eutectic mixture of 60 wt % $NaNO_3$ and 40 wt % $KNO_3$, each wt % being based on the total weight of the mixture.

In the preferred embodiments of the present invention, the phase change material 6 comprises dispersed particles (not shown) having an average particle size within the range of from 10 nm to 10 microns, preferably from 20 nm to 1 micron, for example from 20 nm to 0.2 microns.

Typically, the dispersed particles in the phase change material 6 are in the form of agglomerates of primary particles, wherein the primary particles are nanoparticles or sub-micron particles which have an average particle size of from 1 to 500 nm.

The composite phase change material 4 comprises at least 40 wt % of the phase change material 6, based on the total weight of the composite phase change material 4. In preferred embodiments of the present invention, the composite phase change material 4 comprises from 40 to 85 wt %, preferably from 50 to 85 wt %, of the phase change material 6, based on the total weight of the composite phase change material 4.

The phase change material 6 is in the form of a continuous phase, a discrete phase, or a mixture of continuous and discrete phases distributed within the composite phase change material 4. In FIG. 1, the phase change material 6 is illustrated in the form of a continuous phase.

The structural material 8 provides the functional technical effect of structurally shape-stabilising the phase change material 6. Such shape stabilisation can enhance the heat transfer function of the composite phase change material 4, and can assist in preventing or minimising leakage of the phase change material 6 from the module 2. The structural material 8 comprises particles 18 which are solid in the predetermined working temperature range including the predetermined transition temperature. The particles 18 of the structural material 8 include porous particles, non-porous particles, or a mixture of porous and non-porous particles. The particles 18 of the structural material 8 are also chemically compatible with the phase change material 6, i.e. the phase change material 6 and the structural material 8 do not react chemically prior to or during operation of the thermal energy storage module 2. However, the structural material 8 may physically interact with the phase change material 6; for example, the structural material 8 may have a high surface energy towards the phase change material 6, which can increase a binding effect between the structural material 8 and the phase change material 6, which enhances the structural stabilisation of the phase change material 6 by the structural material 8.

In order to achieve the functional technical effect of structurally shape-stabilising the phase change material 6, the phase change material 6 is contained in interparticle regions 20 between the particles 18 of the structural material 8, when the structural material 8 comprises porous and/or non-porous particles. When the structural material 8 comprises porous particles the phase change material 6 is additionally contained in intraparticle regions 22 within the porous particles 18 of the structural material 8. Typically, the particles 18 of the structural material 8 are randomly packed in the composite phase change material 4, with both the interparticle regions 20 and intraparticle regions 22 containing the phase change material 6.

The structural material 8 may be composed of any material, or mixture of materials, which are known to persons skilled in the art for use as structural materials in composite phase change materials. For example, the particles 18 of the structural material 8 may be selected from the group consisting of inorganic particles, carbon particles, and polymeric particles, or any mixture of two or more thereof. Inorganic particles are typically used for medium and high temperature PCM applications whereas carbon and organic particles are typically used for low and medium temperature PCM applications.

In some preferred embodiments of the present invention, the structural material 8 comprises inorganic particles 18 composed of a material selected from the group consisting of solid and/or porous alkaline earth metal oxides, vermiculite, diatomite, and clay minerals, or any mixture of two or more thereof. A preferred metal oxide is magnesium oxide (MgO), used alone or in combination with any other structural material described herein. Magnesium oxide has the advantages of cost-effectiveness and a good binding capability to the PCM, which facilitates a manufacturing process in which the module is shaped under pressure to form the CPCM. The inorganic particles 18 may be retrieved from industrial waste materials, such as red mud, and iron and steelmaking slags, for cost-effectiveness and enhanced material recycling. The organic particles may comprise polymeric particles 18 which may be composed of high density polyethylene (HDPE). The carbon particles 18 may be composed of graphite, for example expanded graphite.

In preferred embodiments of the present invention, the particles 18 of the structural material 8 have an average particle size within the range of from 5 to 2000 microns, for example from 20 to 150 microns.

The composite phase change material 4 comprises at least 10 wt % of the structural material 8, or at least 15 wt % of the structural material 8, based on the total weight of the composite phase change material 4. Preferably, the composite phase change material 4 comprises from 15 to 60 wt %, of the structural material 8 based on the total weight of the composite phase change material 4.

In preferred embodiments of the present invention, the composite phase change material further comprises the anti-leakage additive 10. The anti-leakage additive 10 is dispersed in the phase change material 6. The anti-leakage additive 10 comprising inert filler particles 24 which are solid in the predetermined working temperature range. Typically, the inert filler particles 24 of the anti-leakage additive have an average primary particle size within the range of from 1 to 500 nanometers, for example from 10 to 100 nanometers. The anti-leakage additive 10 functions as a rheology modifier for the phase change material 6 which reduces flow of the phase change material 6, and thereby reduces leakage of the phase change material 6 from the module 2.

Typically, the inert filler particles 24 comprise one or more of metal oxides, silicon oxides, carbon, carbides, clay, and metal particles. The silicon oxide may be present as fumed silica or amorphous silica.

In some embodiments of the present invention, the inert filler particles 24 of the anti-leakage additive 10 are primary particles or agglomerates comprising a plurality of the primary particles. When agglomerates are present, the agglomerates typically have an average agglomerate particle size within the range of from 10 to 2000 nanometers, for example from 20 to 200 nanometers.

Preferably, the inert filler particles 24, or if present the agglomerates, are randomly and uniformly dispersed in the phase change material 6.

Preferably, the composite phase change material 4 comprises from 0.01 to 10 wt %, for example from 0.1 to 5 wt % of the anti-leakage additive 10, based on the total weight of the composite phase change material 4.

In some preferred embodiments of the present invention, the composite phase change material 4 further comprises a heat transfer enhancement material 12 dispersed in the phase change material 6. Typically, the heat transfer enhancement material 12 comprises particles 26 selected from the group consisting of carbon, metal oxide, metal, and carbide, or a mixture of any two or more thereof.

It is to be noted that some optional or preferred heat transfer enhancement materials 12 have the same composition as the structural material 8 and/or the anti-leakage additive 10 described hereinabove; such materials for the structural material 8 and/or the anti-leakage additive 10 may therefore also additionally function to provide heat transfer enhancement functionality in the composite phase change material 4.

Preferably, the particles 26 of the heat transfer enhancement material 12 have an average particle size within the range of from 0.01 to 100 microns, for example from 0.05 to 10 microns.

In preferred embodiments of the present invention, the composite phase change material 4 comprises from 0.001 to 20 wt %, for example from 0.01 to 10 wt %, of the heat transfer enhancement material 12, based on the total weight of the composite phase change material 4.

The composite phase change material 4 comprises a plurality of voids 16 distributed within the composite phase change material 4. Typically, the voids 16 are randomly and uniformly dispersed in the phase change material 4.

The plurality of voids 16 provides the functional technical effect that the plurality of voids 16 accommodates at least a portion of a volumetric expansion of both the phase change material 6 and the structural material 8 in the predetermined working temperature range.

Typically, the voids 16 have a total volume fraction of from 1 to 30%, for example from 5 to 20%, based on the total volume of the composite phase change material 4 at 25° C.

In some embodiments of the present invention, the voids 16 have an average width within the range of from 0.01 to 100 microns, for example from 0.05 to 20 microns.

In some embodiments of the present invention, the composite phase change material 4 further comprises an exterior layer 14 adjacent to and surrounding at least a portion of an external surface 30 of the composite phase change material 4. Preferably, the exterior layer 14 seals the composite phase change material 4 against at least one of, or two or more of, (a) leakage of the phase change material 6 from the composite phase change material 4, (b) oxidation of components of the composite phase change material 4 by an oxidising environment, and (c) corrosion of surrounding materials in contact with the composite phase change material module 2 by a corrosive component of the composite phase change material 4.

The exterior layer 14 may be independently applied to the external surface 30 of the composite phase change material 4. Alternatively, the exterior layer 14 may be formed on the external surface 30 as a result of capillary action, a lubricating effect of the heat transfer enhancement material 12 and/or non-wetting of the heat transfer enhancement material 12, which can cause some of the structural material 8 and/or the heat transfer enhancement material 12 to form a distinct surface layer constituting the exterior layer 14.

Typically, the exterior layer 14 has a total thickness of from 10 to 4000 microns, optionally from 100 to 2000 microns.

Preferably, the exterior layer 14 comprises at least one, or both, of (a) a chemically reducing agent 32 (schematically indicated by filled circles in FIG. 1), for decreasing any oxidation of the components of the composite phase change material 4 and/or (b) an inorganic particulate 34 (schematically indicated by unfilled ovals in FIG. 1), which is solid in the predetermined working temperature range. The exterior layer 14 typically comprises a mixture of the chemically reducing agent 32 and the inorganic particulate 34.

The chemically reducing agent 32 typically comprises a carbon material e.g. graphite, carbides e.g. silicon carbide, and/or a metallic material e.g. iron, or any mixture thereof.

Preferably, the chemically reducing agent 32 is in the form of a particulate, wherein the particulate of the chemically reducing agent has an average particle size within the range of from 0.02 to 1000 microns, for example from 0.05 to 100 microns.

The inorganic particulate 34 of the exterior layer 14 typically has the same composition and/or particle size as the structural material 8.

In the thermal energy storage modules 2 of the preferred embodiments of the present invention, the phase change material 6 and the structural material 8 are physically compatible and the phase change material 6 wets the structural material 8 when the phase change material 6 is in the liquid state; consequently when the phase change material 6 is solidified the phase change material 6 and the structural material 8 form a compact structure. The phase change material 6 and the heat transfer enhancement material 12 are typically less physically compatible than the phase change material 6 and the structural material 8; consequently, typically the phase change material 6 does not effectively wet the heat transfer enhancement material 12 when the phase change material 6, for example droplets of the phase change material 6 may be formed at the surface of the heat transfer enhancement material 12; when the phase change material 6 is solidified the phase change material 6 and heat transfer enhancement material 12 form a loose structure. The phase change material 6 and the anti-leakage additive 10 are typically physically compatible and the anti-leakage additive 10 can be well dispersed in the phase change material 6 when the phase change material 6 is in the liquid state or the solid state.

The various components of the composite phase change material 4 are not typically sintered together. When the phase change material 6 is in the solid state the mechanical strength of the composite phase change material 4 is mainly due to the particles 18 of the structural material 8 being held by solid bridges between the particles whereas when the phase change material 6 is in the liquid state the mechanical strength of the composite phase change material 4 is mainly due to the particles 18 of the structural material 8 being held by liquid bridges between the particles. The structural material enhances the mechanical strength and the anti-leakage additive enhances the viscosity of the phase change material 6 in the liquid state, and the voids accommodate volumetric changes as a result of phase changes, which enhances the structural strength of the composite phase change material 4.

These features enable the composite phase change material 4 to exhibit highly desirable properties for thermal energy storage, with good thermal capacity and thermal conductivity, good physical and chemical stability and compatibility, and good mechanical properties, which can also be manufactured in a cost-effective manner.

The thermal energy storage module 2 is typically manufactured by the following two manufacturing methods, which are used when the phase change materials comprise at least one inorganic salt. In one non-limiting example of small-scale manufacturing, an anti-leakage additive comprising inert filler primary particles, such as amorphous silica having an average particle diameter of 10 nm in this example, is dispersed in deionized water and placed in an ultrasonic bath for 90 minutes to sonicate the mixture and homogenise the dispersion of the inert filler particles. An inorganic salt, for example comprises a eutectic mixture of 60 wt % $NaNO_3$ and 40 wt % $KNO_3$, each wt % being based on the total weight of the mixture, is added to the homogenised dispersion of the inert filler particles. The resultant mixture is then placed in an ultrasonic bath to sonicate the mixture until the eutectic salt mixture has fully dissolved, which may take up to 180 minutes. The resultant mixture is then dried in an oven at a temperature of about 150° C. until the deionized water is completely evaporated. Then the PCM salt/anti-leakage additive mixture is milled to form particles. The milled particles are then mixed with structural material particles, in this example MgO particles, and with heat transfer enhancement material particles, in this example graphite particles. The structural material particles and heat transfer enhancement material particles have typically been previously milled to a desired particles size. The resultant mixture is then kneaded, and then shaped, typically under pressure to form a shaped body. Typically, a pressure of 30-80 MPa is applied for a period of 2 minutes. Typically, shaped body is in the shape of a sphere, brick, disc or rod. The shaped body is then dried. If an exterior layer is provided, the materials of the exterior layer are applied to the surface of the composite phase change material before or after shaping to form the shaped body. Thereafter, the fabricated composite phase change material is heated in a furnace to weakly sinter the components to form a coherent unitary structure, for example, by heating in a furnace at a temperature of about 390° C. for a period of about 5 hours. This example of a step sequence in the manufacturing method forms a thermal energy storage module in accordance with an embodiment of the present invention.

In another non-limiting example of large-scale manufacturing, an anti-leakage additive comprising inert filler primary particles, such as amorphous silica having an average particle diameter of 10 nm in this example, is dispersed in distilled water through high shear mixing. The high shear mixing uses a mixing device, IKA® high speed homogeniser in this example, which typically takes 5-20 minutes to obtain a suspension of the inert filler particles. The suspension is then sprayed onto the inorganic salt particles, for example comprises a eutectic mixture of 60 wt % $NaNO_3$ and 40 wt % $KNO_3$, each wt % being based on the total weight of the mixture. The salt particles are mixed and kneaded in a mixer during the spraying to ensure good mixing. Typically, this process takes 10-30 minutes at room temperature (25° C.) and 2-10 wt % of the suspension with respect to the weight of the salt is used in the process. The resulting PCM/anti-leakage mixture is then mixed with structural material particles, in this example MgO particles, and with heat transfer enhancement material particles, in this example graphite particles. This process takes place in a low-speed shear mixer, a rotating drum in this example. The structural material particles and heat transfer enhancement material particles have typically been previously milled to a desired particles size. The resultant mixture is then then shaped in a press, typically under pressure to form a shaped body. Typically, a pressure of 5-60 MPa is applied for a period of 1-8 minutes including a pressure holding time of 0-3 minutes. Typically, shaped body is in the shape of a brick or disc. The shaped body is then dried. If an exterior layer is provided, the materials of the exterior layer are applied to the surface of the composite phase change material before or after shaping to form the shaped body. Thereafter, the fabricated composite phase change material module is heated in a furnace to weakly sinter the components to form a coherent unitary structure, for example, by heating in a furnace at a temperature between room temperature (25° C.) and 350° C. for a period of about 8 hours including temperature holding time and cooling down time. This example of a step sequence in the manufacturing method forms a thermal energy storage module in accordance with an embodiment of the present invention.

As shown in FIG. 2, the present invention also provides a thermal energy storage unit 36 comprising at least one thermal energy storage module 2 according to the present invention as described hereinabove. In the illustrated embodiment there are nine modules 2, although any number may be selected. The at least one thermal energy storage module 2 is assembled into a three-dimensional shape to form the thermal energy storage unit 36. Typically the thermal energy storage unit 36 is in the shape of a sphere, brick, disc or rod. Typically, the thermal energy storage unit 36 has a volume of from 100 $mm^3$ to 100 $m^3$.

The thermal energy storage unit 36 may further comprise a casing 38 which surrounds the composite phase change material and is in direct thermal contact with the composite phase change material module(s). Typically, the casing 38 is composed of a metal (e.g. steel), a ceramic, or an enamelled metal casing. The selection of the material of the casing 38, and the mechanical properties of the casing 38, is made based on the intended application or use of the thermal energy storage unit 36.

In a further aspect of the present invention, there is provided a thermal energy storage device comprising a plurality of the composite phase change material units 36 which are assembled together in direct or indirect thermal contact to form a unitary assembly of the units 36.

Various modifications to the illustrated embodiments as described hereinabove will be apparent to those skilled in the art and are intended to be included within the scope of the present invention as defined by the appended claims.

The invention claimed is:

1. A thermal energy storage module comprising a composite phase change material, wherein the composite phase change material comprises:

(i) a phase change material having a composition which absorbs or releases heat isothermally, or substantially isothermally, by transitioning, in a respective transition direction, between a first phase state and a second phase state at a predetermined transition temperature, wherein the composite phase change material comprises at least 40 wt % of the phase change material, based on the total weight of the composite phase change material, the phase change material being in the form of a continuous phase or a mixture of continuous and discrete phases distributed within the composite phase change material, wherein the phase change material comprises at least one inorganic salt or a mixture of a plurality of inorganic salts, and wherein the phase change material further comprises dispersed particles for providing anti-leakage additive and heat transfer enhancement functionalities; wherein the composite phase change material further comprises (ii) a structural material for structurally shape-stabilising the phase change material, the structural material comprising particles which are solid in a predetermined working temperature range including the predetermined transition temperature and are chemically compatible with the phase change material, wherein, for structurally shape-stabilising the phase change material, the phase change material is contained in interparticle regions between the particles of the structural material, wherein the composite phase change material comprises at least 10 wt % of the structural material, based on the total weight of the composite phase change material and wherein the particles of the structural material have an average particle size within the range of from 20 to 150 microns; and (iii) a plurality of voids distributed within the composite phase change material, the plurality of voids being randomly and uniformly dispersed in the phase change material, wherein the plurality of voids accommodates at least a portion of a volumetric change of both the phase change material and the structural material in the predetermined working temperature range.

2. The thermal energy storage module according to claim 1, wherein the at least one inorganic salt, or a mixture of a plurality of any of the inorganic salts, is selected from the group consisting of nitrates, nitrites, carbonates, chlorides, bromides, fluorides, sulphates, and hydroxides.

3. The thermal energy storage module according to claim 2, wherein the phase change material comprises at least one alkali metal salt.

4. The thermal energy storage module according to claim 1, wherein the phase change material comprises a binary, ternary or quaternary eutectic mixture of individual phase change material components.

5. The thermal energy storage module according to claim 1, wherein the phase change material comprises dispersed particles having an average particle size within the range of from 10 nm to 10 microns.

6. The thermal energy storage module according to claim 1, wherein the composite phase change material comprises from 40 to 85 wt % of the phase change material, based on the total weight of the composite phase change material.

7. The thermal energy storage module according to claim 1, wherein the particles of the structural material are selected from the group consisting of inorganic particles, carbon particles, and polymeric particles, or any mixture of two or more thereof.

8. The thermal energy storage module according to claim 7, wherein the structural material comprises inorganic particles composed of a solid material selected from the group consisting of alkaline earth metal oxides, vermiculite, and clay minerals, or any mixture of two or more thereof.

9. The thermal energy storage module according to claim 1, wherein the structural material comprises porous particles, the phase change material being additionally contained in intraparticle regions within the porous particles of the structural material, wherein the particles of the structural material have an average particle size within the range of from 5 to 2000 microns.

10. The thermal energy storage module according to claim 1, wherein the composite phase change material comprises from 15 to 60 wt % of the structural material, based on the total weight of the composite phase change material.

11. The thermal energy storage module according to claim 1, wherein the particles of the structural material are randomly packed in the composite phase change material, with both the interparticle and intraparticle regions containing the phase change material.

12. The thermal energy storage module according to claim 1, wherein the voids have a total volume fraction of from 1 to 30% based on the total volume of the composite phase change material at 25° C. and wherein the voids have an average width within the range of from 0.01 to 100 microns.

13. The thermal energy storage module according to claim 1, wherein the anti-leakage additive dispersed in the phase change material comprises inert filler particles which are solid in the predetermined working temperature range, wherein the inert filler particles of the anti-leakage additive have an average primary particle size within the range of from 1 to 500 nanometers.

14. The thermal energy storage module according to claim 13, wherein the composite phase change material comprises from 0.01 to 10 wt % of the anti-leakage additive, based on the total weight of the composite phase change material.

15. The thermal energy storage module according to claim 13, wherein the inert filler particles comprise one or more of metal oxides, silicon oxides, carbon, carbides, clay, and metal particles and wherein the inert filler particles of the anti-leakage additive are primary particles or agglomerates comprising a plurality of the primary particles, and wherein the agglomerates have an average agglomerate particle size within the range of from 10 to 2000 nanometers and the inert filler particles of the anti-leakage additive have an average primary particle size within the range of from 10 to 100 nanometers.

16. The thermal energy storage module according to claim 13, wherein the inert filler particles, or if present the agglomerates, are randomly and uniformly dispersed in the phase change material.

17. The thermal energy storage module according to claim 1, wherein the particles of heat transfer enhancement material are selected from the group consisting of carbon, metal oxide, metal, and carbide, or a mixture of any two or more thereof.

18. The thermal energy storage module according to claim 17, wherein the particles of the heat transfer enhancement material have an average particle size within the range of from 0.01 to 100 microns and the composite phase change material comprises from 0.01 to 20 wt % of the heat transfer enhancement material, based on the total weight of the composite phase change material.

19. The thermal energy storage module according to claim 1, wherein the composite phase change material further comprises:

(vi) an exterior layer adjacent to and surrounding at least a portion of an external surface of the composite phase change material, wherein the exterior layer seals the composite phase change material against at least one of, or two or more of, (a) leakage of the phase change material from the composite phase change material, (b) oxidation of components of the composite phase change material by an oxidising environment, and (c) corrosion of surrounding materials in contact with the composite phase change material module by a corrosive component of the composite phase change material.

20. The thermal energy storage module according to claim 19, wherein the exterior layer comprises (a) a chemically reducing agent for decreasing any oxidation of the components of the composite phase change material and/or (b) an inorganic particulate which is solid in the predetermined working temperature range.

21. The thermal energy storage module according to claim 20, wherein the chemically reducing agent comprises a carbon material, a carbide, and/or a metallic material, or any mixture thereof and/or wherein the chemically reducing agent is in the form of a particulate, wherein the particulate of the chemically reducing agent has an average particle size within the range of from 0.02 to 1000 microns.

22. The thermal energy storage module according to claim 21, wherein the carbon material comprises graphite, the carbide comprises silicon carbide, and/or the metallic material comprises iron.

23. The thermal energy storage module according to claim 19, wherein the inorganic particulate of the exterior layer has the same composition and/or particle size as the structural material and/or wherein the exterior layer comprises a mixture of the chemically reducing agent and the inorganic particulate and/or wherein the exterior layer has a total thickness of from 10 to 4000 microns.

24. The thermal energy storage unit comprising at least one thermal energy storage module according to claim 1 which is assembled into a three-dimensional shape to form the thermal energy storage unit, wherein the thermal energy storage unit is in the shape of a sphere, brick, disc or rod.

25. The thermal energy storage unit according to claim 24, further comprising a metal, a ceramic, or an enameled metal casing which surrounds the composite phase change material and is in direct thermal contact with the composite phase change material module(s).

26. The thermal energy storage device comprising a plurality of the composite phase change material units according to 24, wherein the units are assembled together in direct or indirect thermal contact to form a unitary assembly of the units.

* * * * *